US011352815B1

(12) United States Patent
Creacy, III

(10) Patent No.: US 11,352,815 B1
(45) Date of Patent: Jun. 7, 2022

(54) KEYLESS GATE LATCH

(71) Applicant: Daniel D. Creacy, III, Tampa, FL (US)

(72) Inventor: Daniel D. Creacy, III, Tampa, FL (US)

(73) Assignee: NATIONWIDE INDUSTRIES, INC., Tampa, FL (US)

( * ) Notice: Subject to any disclaimer, the term of this patent is extended or adjusted under 35 U.S.C. 154(b) by 136 days.

(21) Appl. No.: 16/873,473

(22) Filed: Apr. 17, 2020

(51) Int. Cl.

| | |
|---|---|
| ***E05B 65/00*** | (2006.01) |
| ***E05B 9/00*** | (2006.01) |
| ***E05B 63/24*** | (2006.01) |
| ***E05B 15/02*** | (2006.01) |
| ***E05B 9/02*** | (2006.01) |
| ***G07C 9/30*** | (2020.01) |

(52) U.S. Cl.
CPC ..... *E05B 65/0007* (2013.01); *E05B 9/002* (2013.01); *E05B 9/02* (2013.01); *E05B 15/022* (2013.01); *E05B 15/025* (2013.01); *E05B 63/24* (2013.01); *G07C 9/30* (2020.01); *E05Y 2900/40* (2013.01); *Y10S 292/29* (2013.01); *Y10T 292/0969* (2015.04); *Y10T 292/696* (2015.04); *Y10T 292/707* (2015.04)

(58) Field of Classification Search
CPC .. E05B 65/0007; E05B 15/022; E05B 15/025; E05B 63/24; Y10T 292/696; Y10T 292/705; Y10T 292/707; Y10T 292/0969; Y10T 292/0994; Y10T 292/0995; Y10T 292/0997; Y10S 292/29; Y10S 292/71
See application file for complete search history.

(56) References Cited

U.S. PATENT DOCUMENTS

| | | | | | |
|---|---|---|---|---|---|
| 347,852 | A * | 8/1886 | White | E06B 3/52 | 49/254 |
| 381,740 | A * | 4/1888 | Wollensak | E05B 15/1635 | 292/204 |
| 975,037 | A * | 11/1910 | Hettwer | E05C 3/162 | 292/126 |
| 978,098 | A * | 12/1910 | Wirts | E05B 65/0042 | 292/242 |
| 1,297,221 | A * | 3/1919 | Mikkelsen | E05B 63/248 | 292/254 |
| 1,337,447 | A * | 4/1920 | Freeman | E05C 3/145 | 292/228 |

(Continued)

FOREIGN PATENT DOCUMENTS

| | | | | |
|---|---|---|---|---|
| DE | 672276 C | * | 2/1939 | E05B 63/24 |

*Primary Examiner* — Carlos Lugo
(74) *Attorney, Agent, or Firm* — Arthur W. Fisher, III

(57) ABSTRACT

A keyless gate latch to selectively latch a gate to a post wherein the keyless gate latch comprises a keeper assembly including a keeper member having a keeper stop movable between a latched position and an unlatched position normally biased in the latched position and a latch assembly including an actuator lever rotatably between a latched position and an unlatched position at least partially disposed within a housing and including a latch stop such that when the latch member and the actuator lever are each in the latched position, the keeper stop and the latch stop when engaged with each other prevent the gate from being opened and when the actuator lever is rotated from the latched position to the unlatched position the actuator lever engages the latch member moving the latch member from the latched position to the unlatched position preventing the keeper stop from engaging the latch stop allowing the gate to be opened.

11 Claims, 8 Drawing Sheets

(56) References Cited

U.S. PATENT DOCUMENTS

| | | | | | |
|---|---|---|---|---|---|
| 1,479,744 | A | * | 1/1924 | Salata | E05B 63/248 70/142 |
| 1,650,398 | A | * | 11/1927 | Swem | E05C 3/167 292/173 |
| 1,675,176 | A | * | 6/1928 | Jarecki | E05B 63/22 292/332 |
| 1,688,526 | A | * | 10/1928 | Crampton | E05C 3/145 292/336 |
| 1,781,172 | A | * | 11/1930 | Graf | E05C 3/145 292/332 |
| 2,572,428 | A | * | 10/1951 | Anstine | E05B 15/0245 292/341.18 |
| 2,759,752 | A | * | 8/1956 | Demings | E05C 1/16 292/337 |
| 4,799,371 | A | * | 1/1989 | Duncan | E05B 37/16 70/214 |
| 4,932,693 | A | * | 6/1990 | Schwartz | E05B 9/02 16/299 |
| 5,199,753 | A | * | 4/1993 | Presley, Jr. | E05B 53/00 292/188 |
| 5,475,996 | A | * | 12/1995 | Chen | E05B 47/0692 70/218 |
| 5,832,756 | A | * | 11/1998 | Herman, Jr. | E05B 63/122 70/131 |
| 5,850,753 | A | * | 12/1998 | Varma | G07C 9/00904 70/278.7 |
| 7,044,511 | B2 | * | 5/2006 | Kliefoth | E05C 19/163 292/251.5 |
| 8,308,205 | B2 | * | 11/2012 | Tejszerski | E05C 3/145 292/230 |
| 9,631,406 | B2 | * | 4/2017 | Chartier | E05B 15/025 |
| 9,903,140 | B2 | * | 2/2018 | Shi | H05K 5/0204 |

* cited by examiner

KEYLESS GATE LATCH

BACKGROUND OF THE INVENTION

Field of the Invention

A keyless gate latch to selectively latch a gate to a fence post.

Description of the Prior Art

There are numerous examples of gate latch devices for latching a gate to a fence post.

For example U.S. Pat. No. 7,044,511 shows a magnetic latch system comprising a latch assembly and a keeper assembly. The keeper assembly includes a magnetically attractable keeper pin. The latch assembly includes a magnet and a movable lever disposed to engage the magnetically attracted keeper pin to move the magnetically attracted keeper pin away from the magnet.

Another example of the prior art is found in U.S. Pat. No. 9,631,406 describing a magnetic gate latch comprises magnetic materials and a latching mechanism attracted into a keeper when the gate latch is closed by a first magnetic force and retained in a unlatched position by a second magnetic force. For example, the latching mechanism comprises a pin without a spring or other biasing mechanism biasing the spring in a direction opposite of a magnet in the keeper assembly. In one example, the pin comprises a magnet on an end of the pin opposite from the keeper assembly, which is attracted toward a ferromagnetic material when the pin is retracted into the housing.

There are also countless examples of keyless locks or latches for use on doors such as shown in U.S. Pat. No. 4,799,371 describing a keyless button lock comprising a plurality of lock buttons wherein each button requires a particular number of presses to attain an open or lock release position. A lock element is provided which, when actuated, returns all buttons to a locked position. The buttons have more than one release or open position so that master and grand master keying can be provided. The lock may be coupled to a door lock mechanism in a single unit to minimize space and complexity.

However, there are a few examples of keyless locks or latches designed to secure gates to fence posts. However, one such example is the Sumo Surface Mounted Mechanical Code Keyless Entry Gate Lock found in a global internet search using key words such as keyless entry gate locks.

While some of the prior art may contain some similarities relating to the present invention, none of them teach, suggested or include all of the advantages and unique combination of features of the invention disclosed hereafter.

SUMMARY OF THE INVENTION

The present invention relates to a keyless gate latch to selectively secure a gate to a fence post comprising a latch assembly mounted to a portion of the gate frame and a keeper assembly mounted to a fence post.

The latch assembly comprises a latch housing to operatively support a key pad to unlock the keyless gate latch when the correct combination is entered and a rotatable handle mounted on the latch housing to rotate an actuator lever between a first or latched position and a second or unlatched position as described hereinafter. A lever housing to house at least a portion of the actuator lever extends outwardly from the latch housing in the direction of the keeper assembly.

The keeper assembly comprises a keeper at least partially disposed within a keeper housing affixed to the fence post comprises a latch member including an inner latch surface normally biased in the first or latched position.

The lever housing comprises a front plate and a back plate to cooperatively form an enclosure or cavity to house the distal or outer portion of the rotatable actuator lever. An opening or window is formed through the back plate such that the latch member extends outwardly from the fence post through the opening or window into the enclosure or cavity when the gate is closed.

When the actuator lever is in the first or latched position the latch member of the keeper is positioned to engage the back plate below the opening or window to prevent the gate from being opened.

When the correct combination of keys is entered on the key pad the rotatable handle is rotated rotating the actuator lever upward to engage the latch member to move the latch member upward against the force of the bias clearing the latch member from the opening or window allowing the gate to be opened.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
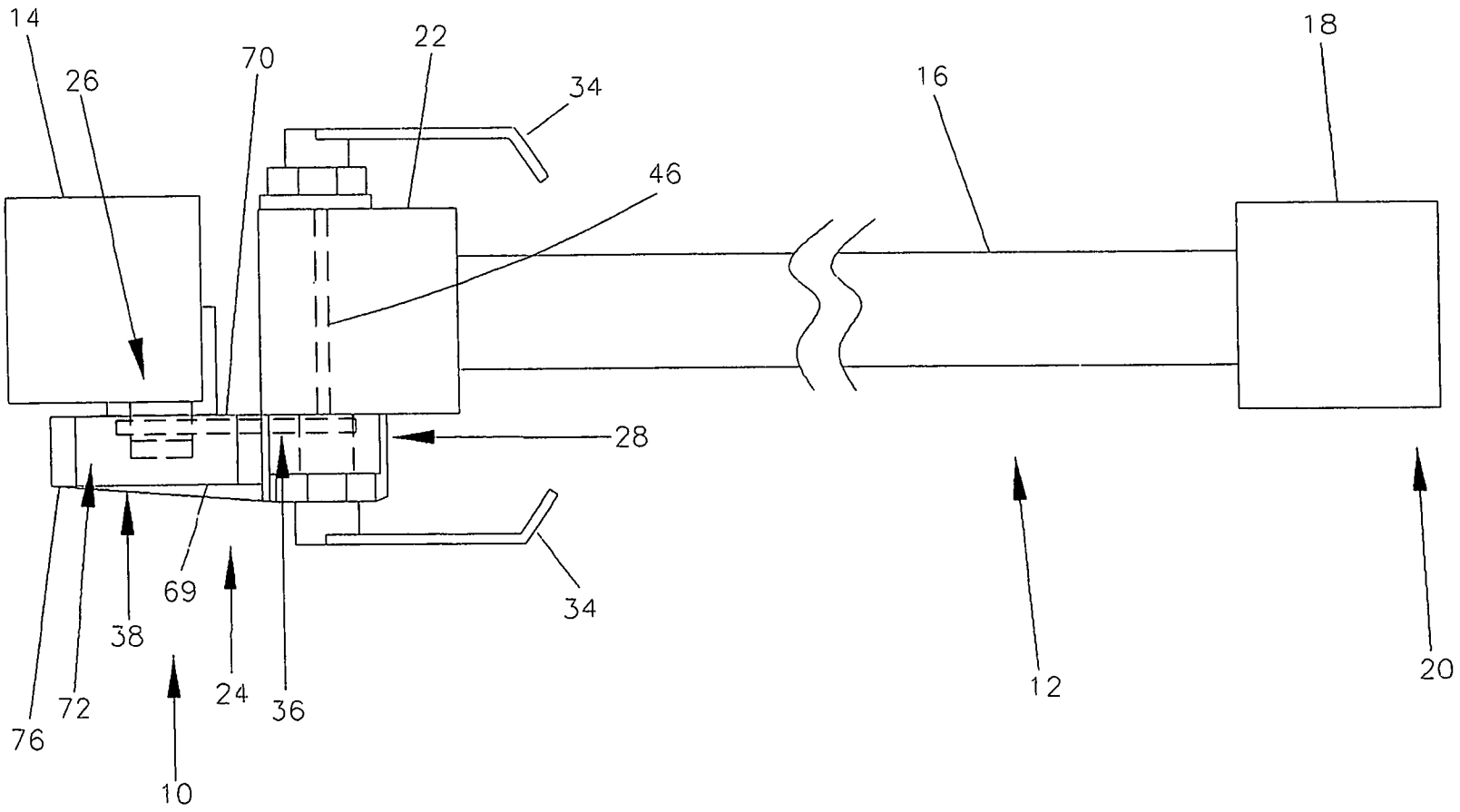
FIG. 1 is a top view of the keyless gate latch of the present invention.

As shown in FIG. 1, the present invention relates to a keyless gate latch generally indicated as 10 to selectively latch a gate generally indicated as 12 to a fence post 14. The gate 12 comprises a barrier 16 such as chain-link extending between a portion of a gate frame 18 on one side of the barrier 16 hingedly coupled or attached to a stationary fence post (not shown) by a hinge generally indicated as 20 and a portion of the gate frame 22 at the opposite side of the barrier 16.

Figure 2:
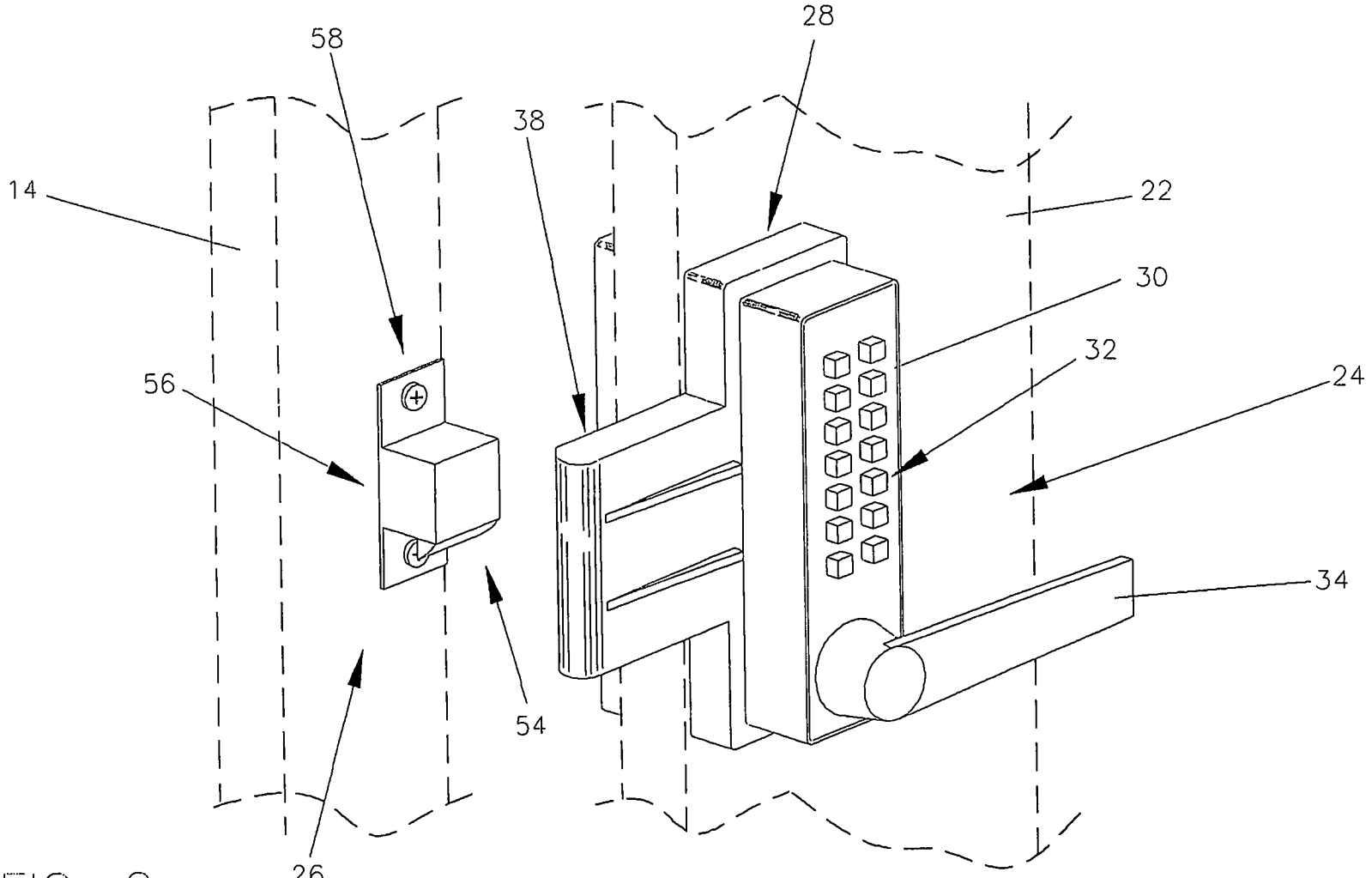
FIG. 2 is a perspective view of the keyless gate latch of the present invention.
Figure 3:
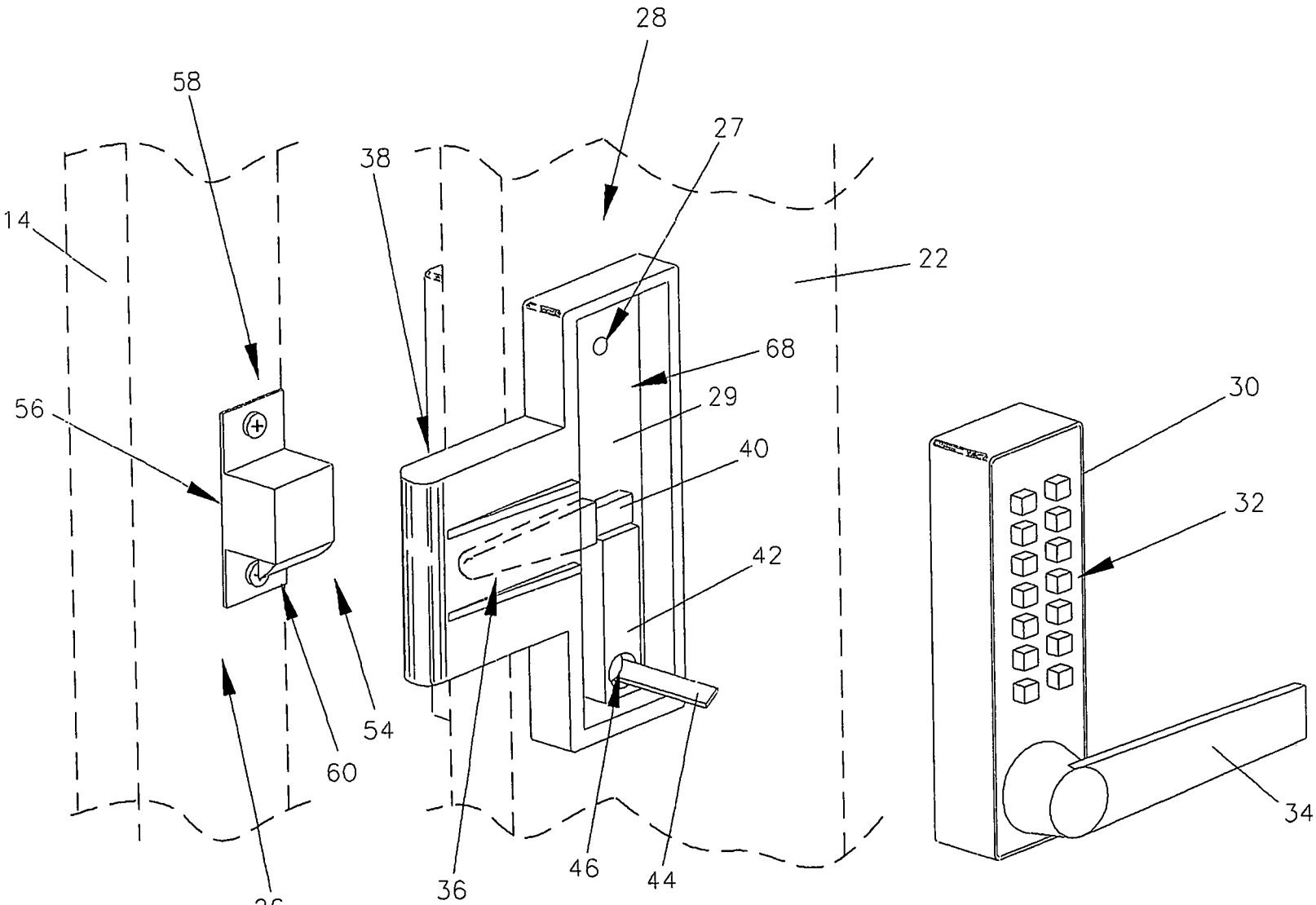
FIG. 3 is a partially exploded perspective view of the keyless gate latch of the present invention.

As shown in FIGS. 2 and 3, the keyless gate latch 10 comprises a latch assembly generally indicated as 24 mounted to the gate frame 22 and a keeper assembly generally indicated as 26 mounted to the fence post 14.

As shown in FIGS. 2 and 3, the latch assembly 24 comprises a latch housing generally indicated as 28 including a hole 27 formed through both the upper portion and the lower portion of the back wall 29 thereof and affixed to a portion of the gate frame 22 to operatively support a key pad 30 including a plurality of keys generally indicated as 32 to selectively unlock the keyless gate latch 10 when the correct combination of keys 32 is entered and a rotatable handle 34 mounted on the key pad 30 to rotate an actuator lever generally indicated as 36 (FIG. 4) between a latched position (FIG. 6) and an unlatched position (FIG. 7) as described hereinafter. A lever housing generally indicated as 38 to house at least a portion of the actuator lever 36 extends outwardly from the latch housing 28 in the direction of the fence post 14 and the keeper assembly 26.

Figure 4:
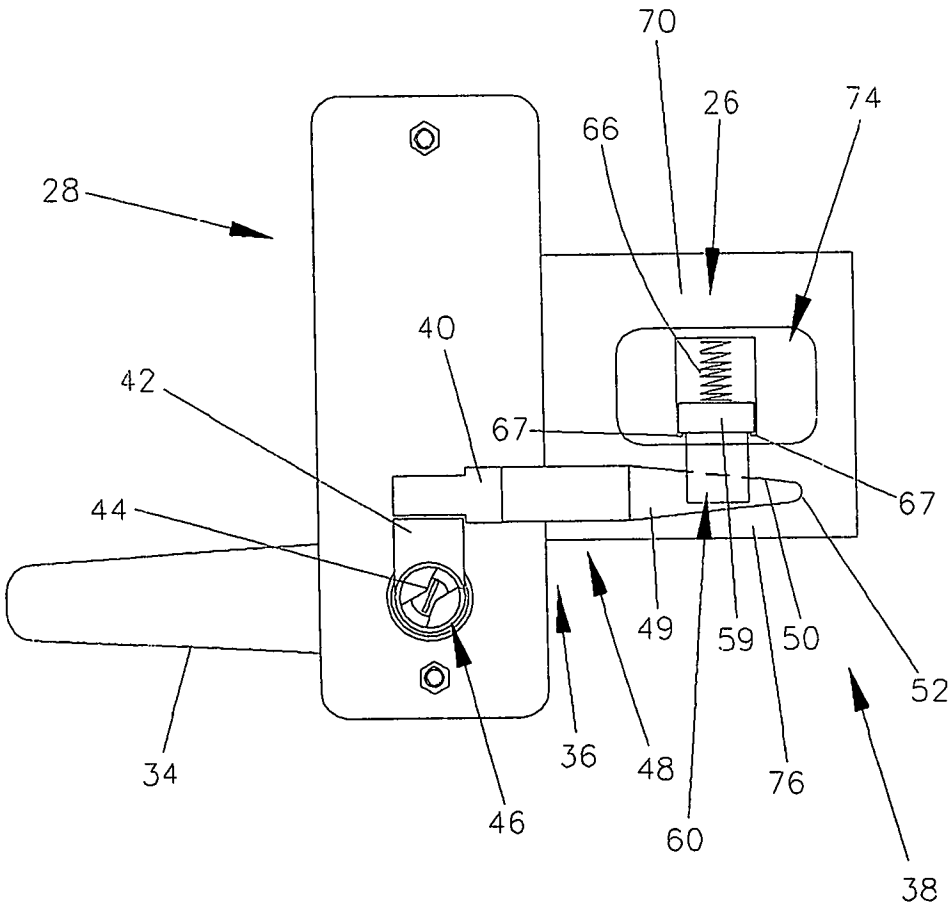
FIG. 4 is a rear view of the latch assembly of the present invention.

As best shown in FIG. 4, the actuator lever 36 comprises a proximal or inner portion 40 coupled to the rotatable handle 34 by an interconnecting spindle support member 42 and a spindle 44 disposed within a spindle hole 46 formed in the interconnecting spindle member 42 and an distal portion generally indicated as 48 including an outer tapered portion 49 having a keeper engaging surface 50 sloping or slanting downward toward the end 52 of the keeper engaging surface 50. The spindle 44 extends through the hole 27 formed through the back wall 29 of the latch housing 28 aligned with the spindle hole 46.

Figure 5:
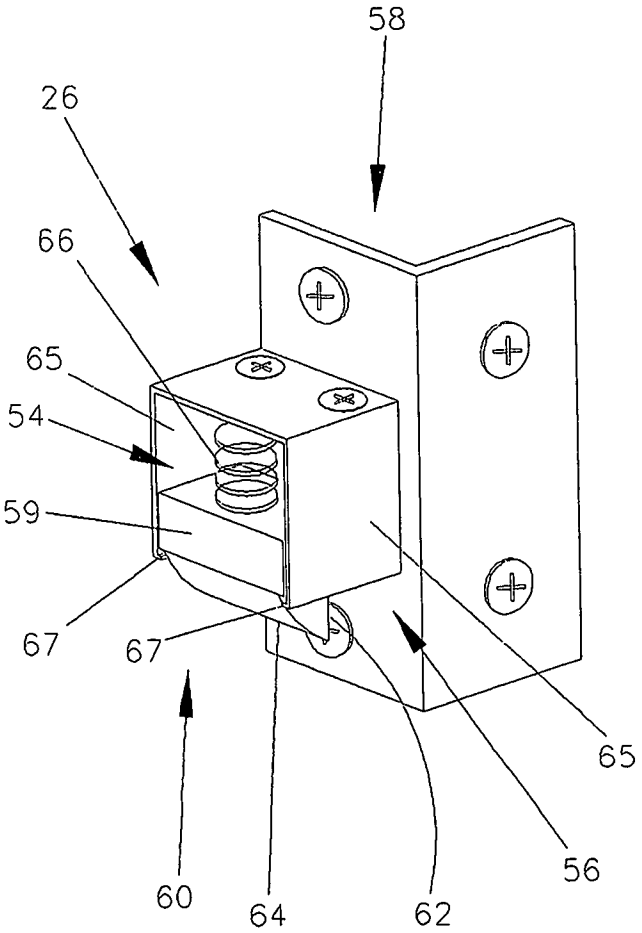
FIG. 5 is a perspective view of the keeper assembly of the present invention.

As best shown in FIG. 5, the keeper assembly 26 comprises a keeper generally indicated as 54 at least partially disposed within a keeper housing generally indicated as 56 affixed to the fence post 14 by a keeper mount generally indicated as 58. The keeper 54 comprises an upper block or member 59 and a lower latch member generally indicated as 60 including a substantially flat inner latch surface or keeper stop 62 and an outer convex cam surface 64 movable between a latched position (FIGS. 4 and 6) and an unlatched position (FIG. 7) normally biased in the latched position by a bias 66 such as a spring. The width of the upper block or member 59 is greater than the width of the lower latch member 60 that extends through an opening 69 (FIG. 8) in the bottom of the keeper housing 56. The lower end portions of side walls 65 of the keeper housing 56 extend inwardly to form corresponding support ledges or rails 67 to support and retain the upper block or member 58 within the keeper housing 56.

As shown in FIGS. 3 and 4, the latch housing 28 includes a cavity 68 to house the proximal or inner portion of the actuator lever 36, the interconnecting spindle member 42 and the outer portion of the spindle 44 (FIG. 1).

Figure 6:
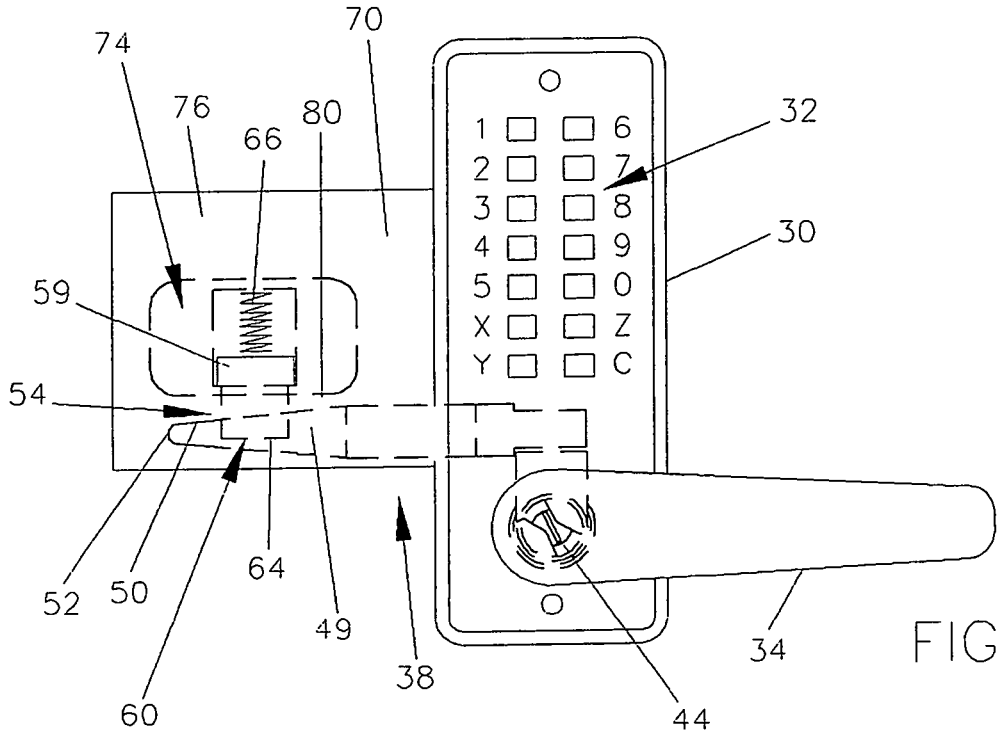
FIG. 6 is a partial cross-sectional view of the keyless gate latch of the present invention in the latched position.
Figure 7:
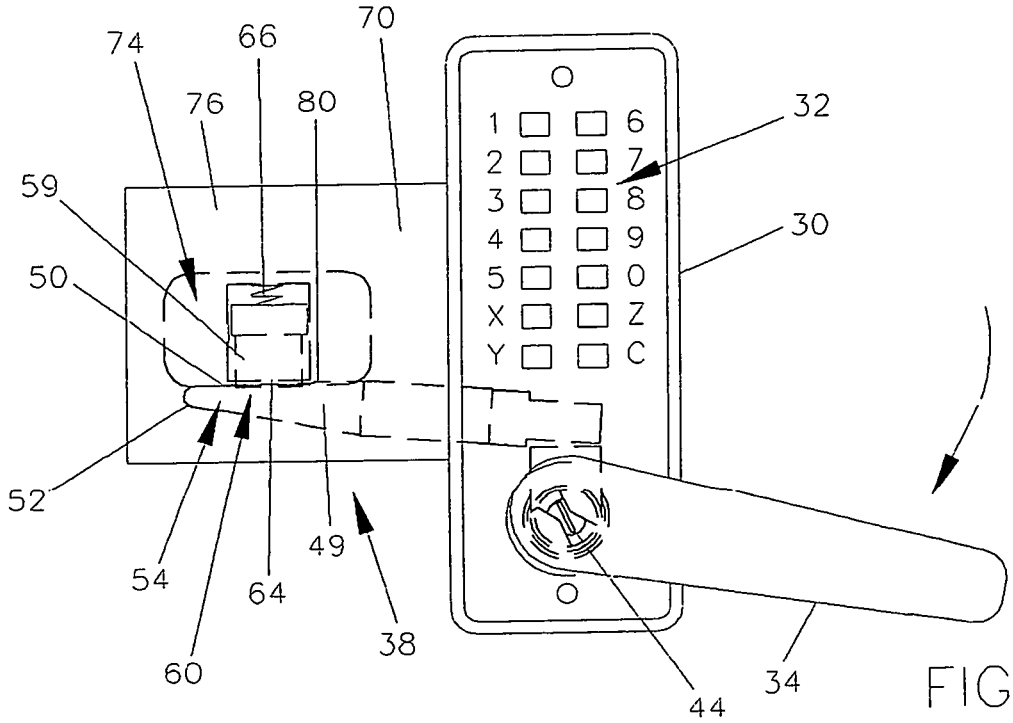
FIG. 7 is a partial cross-sectional view of the keyless gate latch of the present invention in the unlatched position.

As shown in FIG. 1, the lever housing 38 comprises a front plate or wall 69 and a back plate or wall 70 to cooperatively form a lever enclosure or cavity 72 to house the distal or outer portion 48 of the actuator lever 36. As best shown in FIGS. 6 and 7, an opening 74 is formed through the back plate or wall 70 of the lever housing 38 such that the upper block or member 59 and the lower latch member 60 of the keeper 54 extend outwardly from the fence post 14 through the opening 74 into the enclosure or cavity 72 when the gate 12 is closed.

As shown in FIGS. 4 through 6 when the keyless gate latch 10 is in the latched position, the actuator lever 36 is disposed in a substantially horizontal position such that the substantially flat inner latch surface or keeper stop 62 of the keeper 54 engages the inner surface or the latch stop 76 of the back plate or wall 70 below the opening 74 to prevent the gate 12 from being opened when a person attempts to open the gate 12.

As shown in FIG. 7, when the correct combination of keys 32 is entered on the key pad 30 the rotatable handle 34 is rotated to rotate the spindle 46 and the actuator lever 36. As the actuator lever 36 is rotated upward from the latched position to the unlatched position the sloping or slanting keeper engaging surface 50 of the outer tapered portion 49 of the distal portion 48 of the actuator lever 36 engages the outer convex cam surface 64 of the lower latch member 60 to move the lower latch member 60 upward against the force of the bias 66 and into the keeper housing 56 clearing the lower latch member 60 from the opening 74 allowing the gate 14 to be opened. Once the bias or spring 66 forces or returns the lower latch member 60 downward to the latched position the gate 12 is closed such that the lower latch member 60 is no longer disposed within the keeper housing 56 extending below the opening 74.

Figure 8:
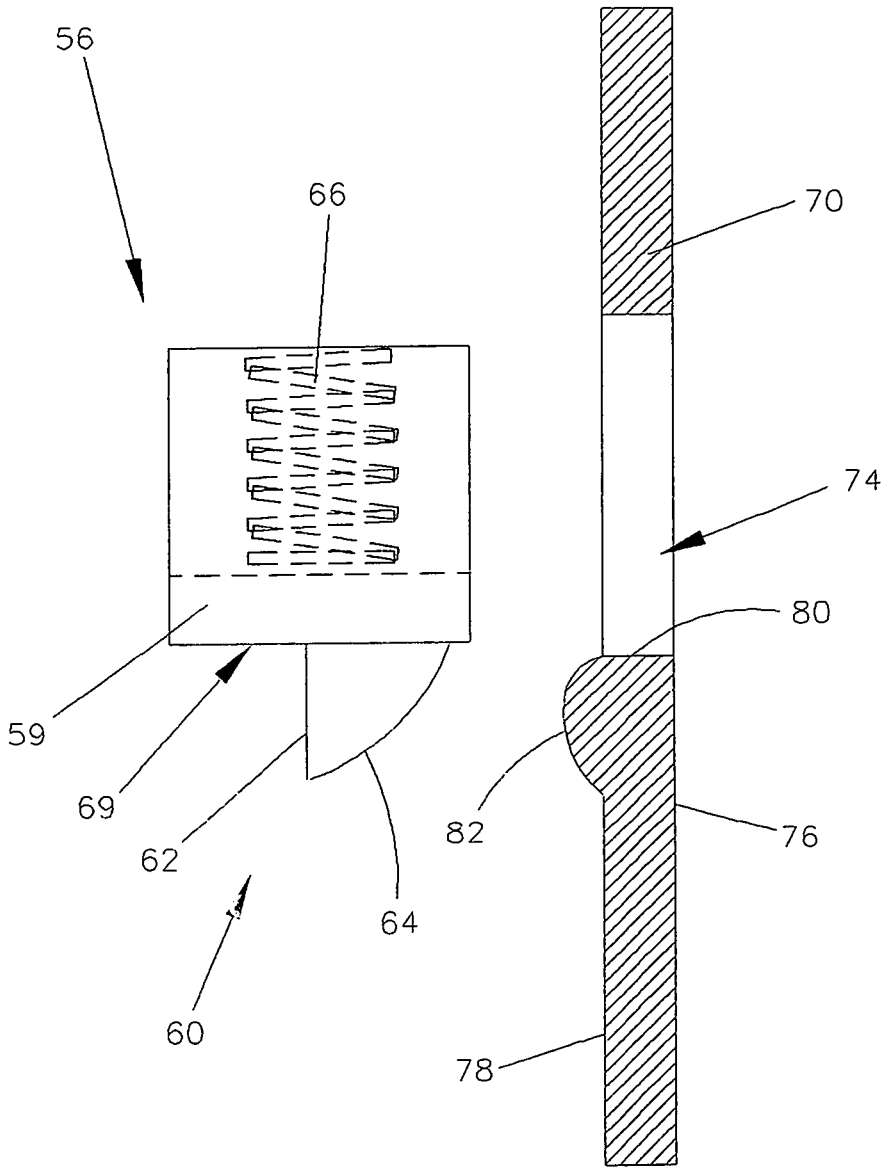
FIG. 8 is a detailed cross-sectional view of the outer convex cam surface of the lower latch member and the convex cam surface of the present invention formed on the back plate or wall of the lever housing.

As shown in FIG. 8, as the gate 12 is closed the edge of the outside surface 78 of the back plate or wall 70 adjacent the lower edge 80 of the opening 74 comprising a convex cam surface 82 engages the outer convex cam surface 64 of the lower latch member 60 forcing the lower latch member 60 upward further into the keeper housing 56 allowing the keeper assembly 26 to pass through the opening 74 formed in the back plate or wall 70 and into the enclosure or cavity 72 as the actuator lever 36 returns to the latched position allowing the lower latch member 60 to extend downward such that the substantially flat inner surface 62 of the keeper 54 engages the inner surface or inside surface 76 of the back plate 70 adjacent the opening or window 74 to latch the gate 12 in the latched position when a person attempts to open the gate 12.

Figure 10:
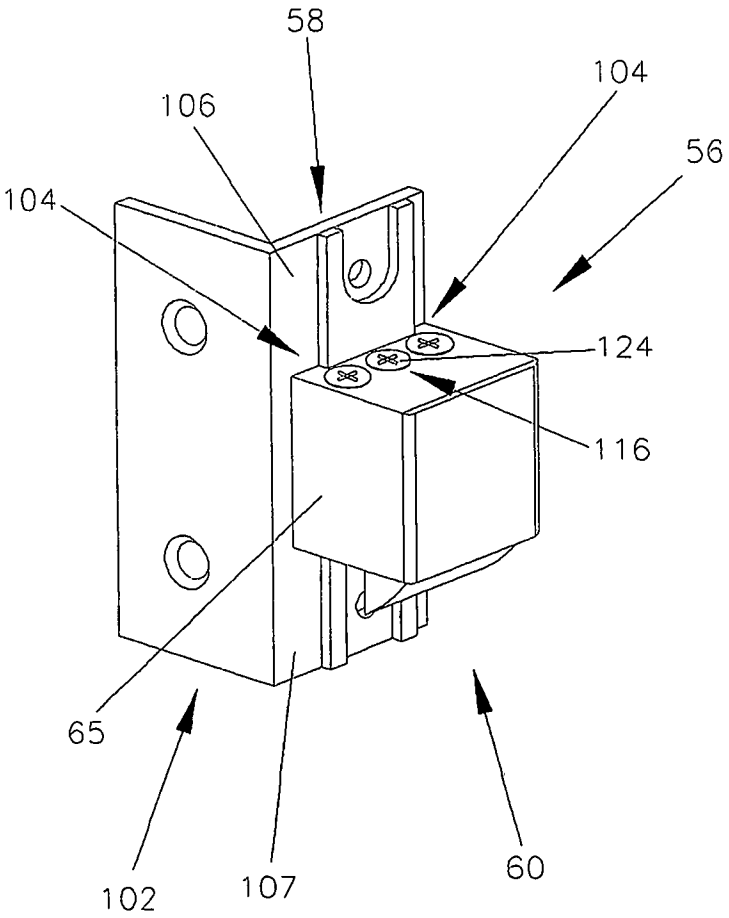
FIG. 10 is a detailed view of an alternate embodiment of the keeper assembly and keeper mount of the present invention for a right-handed gate.
Figure 9:
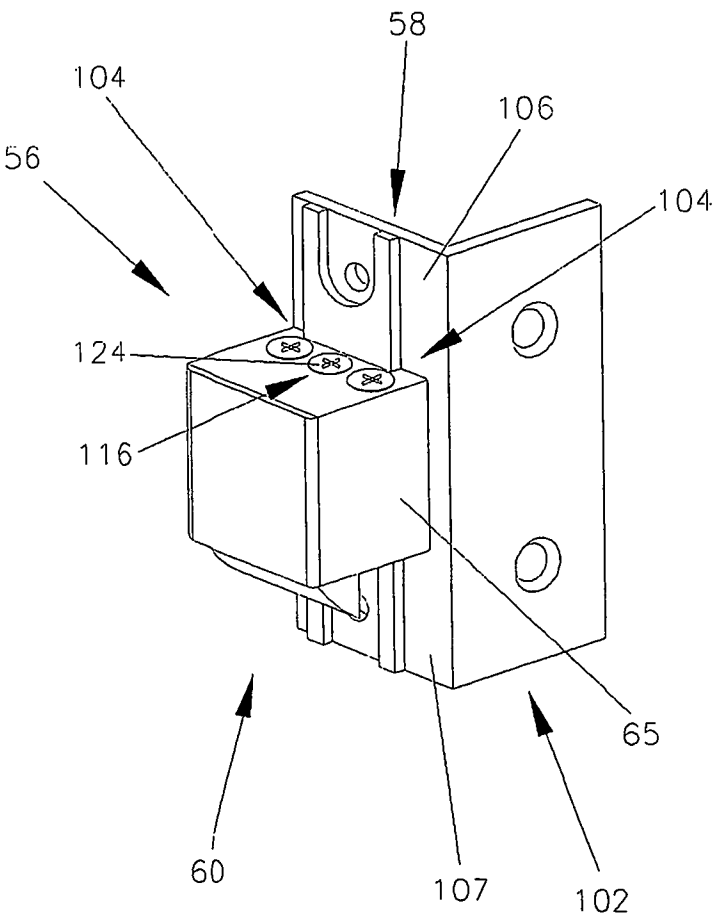
FIG. 9 is a detailed view of an alternate embodiment of the keeper assembly and keeper mount of the present invention for a left-handed gate.
Figure 11:
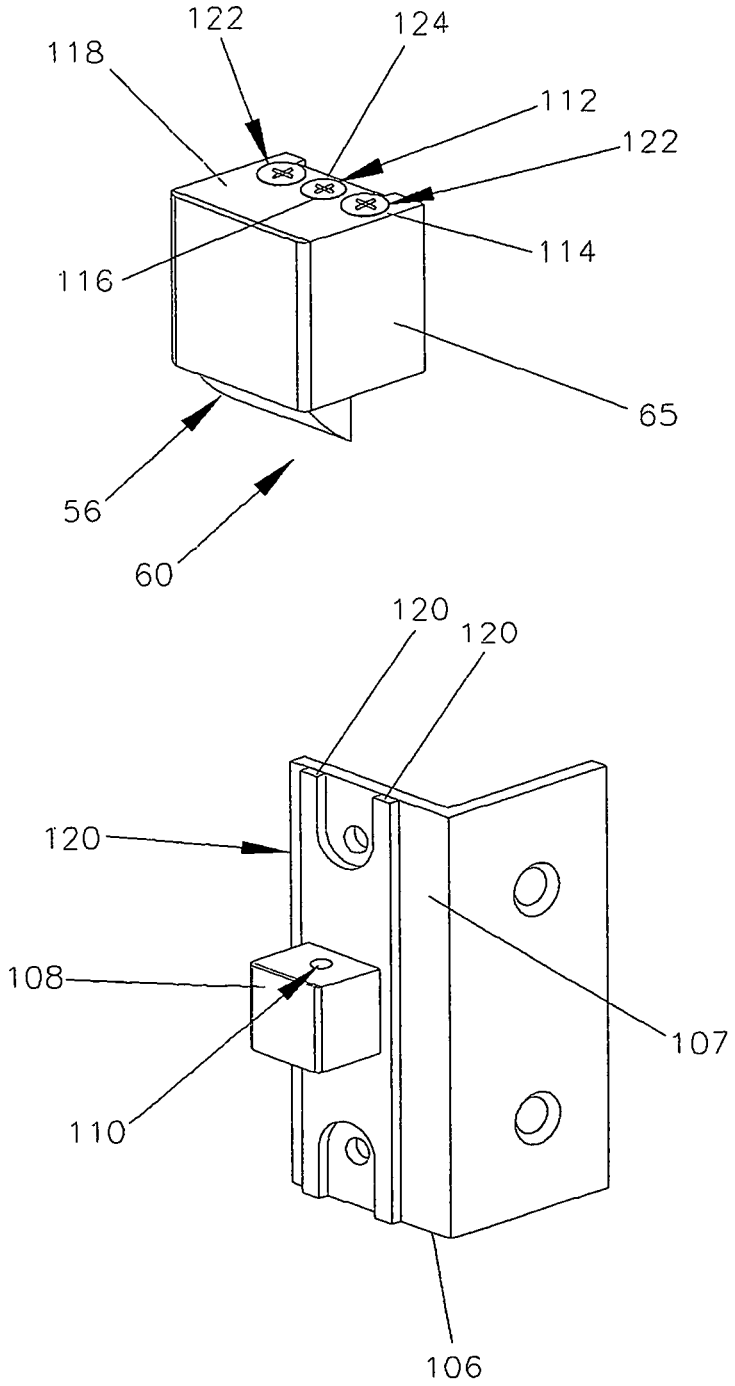
FIG. 11 is an exploded view of the alternate embodiment of the keeper assembly and keeper mount of the present invention.

In an alternate embodiment, the keeper assembly 26 may be vertically adjustable mounted on the fence post 14. In particular as shown in FIGS. 9 through 11, the keeper mount 58 comprises an L-shaped bracket generally indicated 102 having a pair of substantially vertical, substantially parallel dove tailed joints each generally indicated as 104 formed on the outer surface 107 of one leg 106 of the L-shaped bracket 102 and a keeper housing support 108 including a threaded hole 110 and disposed between the substantially parallel, substantially vertical dove tail joints 104. The keeper housing 56 includes a slot 112 formed on the back wall 114 thereof between the substantially parallel, substantially vertical dove tail joints 104 and an aperture 116 formed through the top wall 116 thereof. Each dove tail joint 104 comprises a tapered projection 120 extending outwardly from the outer surface 107 of the leg 106 and a corresponding notch or recess 122 formed on the back wall 114 of the keeper housing 56 on opposite sides of the slot 112.

To assemble, the notch or recess 122 formed on each side of the slot 112 on the back wall 114 of the keeper assembly 26 is aligned with and slide over the corresponding tapered projection 120 extending outwardly from the outer surface 107 of the leg 106. The position of the keeper housing 56 relative to the keeper housing support 108 is adjusted by extending an adjustment screw 124 through the aperture 116 and into the threaded hole 110 then turning the adjustment screw 124 until the keeper 54 is vertically aligned with the actuator lever 36.

Since a threaded hole 110 may be formed in both the top and bottom of the keeper housing support 108 and a hole 27 may be formed at both end portions of the back wall 29 of the latch housing 28 of the keyless gate latch 10, the keyless gate latch 10 may be used on either a left-hand gate or right-hand gate 12. This is accomplished by simply rotating the keeper mount 58 and the latch housing 28 one hundred and eighty degrees or upside down as it were.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of the claims hereinafter.

Now that the invention has been described,

What is claimed is:

1. A keyless gate latch to selectively latch a gate to a fence post wherein said keyless gate latch comprises a keeper assembly including keeper housing attached to the fence post and extending outwardly therefrom, said keeper assembly further including a latch member having a keeper stop and movable between a latched position and an unlatched position normally biased in said latched position and a latch assembly attached to the gate and including an actuator lever rotatably between a latched position and an unlatched position at least partially disposed within a latch housing and a lever housing extending outwardly from said latch housing and including a latch stop such that when said latch member and said actuator lever are each in said latched position, said keeper stop and said latch stop engage each other to prevent the gate from being opened when a person attempts to open the gate and when said actuator lever is rotated from said latched position to said unlatched position said actuator lever engages said latch member moving said latch member from said latched position to said unlatched position preventing said keeper stop from engaging said latch stop allowing the gate to be opened and wherein said latch member comprises an inner surface including said keeper stop and said lever housing comprises a front plate and a back plate including an opening formed through said back plate and having an inner surface and an outer surface to cooperatively form a lever cavity to house a distal portion of said actuator lever wherein, when said gate is moved toward a closed position, said opening formed through said back plate is configured to receive said keeper housing within so as to allow said keeper stop and latch stop to engage each other, said keeper mount comprises a bracket including a pair of substantially vertical, substantially parallel dove tailed joints extending outwardly from a surface of said bracket and a keeper housing support disposed between said substantially parallel, substantially vertical dove tail joints including a slot.

2. The keyless gate latch of claim 1 wherein said inner surface of said keeper stop is disposed to engage said inner surface of said back plate of said lever housing adjacent a lower edge of said opening formed through said back plate of said lever housing such that said keeper stop is disposed within said lever housing and at least partially below said lower edge of said opening when said actuator lever is in said latched position to prevent the gate from being opened.

3. The keyless gate latch of claim 2 wherein said keeper stop further includes a convex cam surface disposed to engage said outer surface of said back plate adjacent said lower edge of said opening forcing said latch member upward allowing said keeper assembly to pass through said opening formed in said back plate and into said lever cavity as said actuator lever returns to said latched position allowing said latch member to extend downward such that said inner surface of said keeper stop is disposed to engage said inner surface of said back plate adjacent said opening to latch the gate in said latched position when a person attempts to open the gate.

4. The keyless gate latch of claim 1 wherein said keeper stop further includes a convex cam surface disposed to engage a convex cam surface formed on said outer surface of said back plate adjacent said lower edge of said opening forcing said latch member upward allowing said keeper assembly to pass through said opening formed in said back plate and into said lever cavity as said actuator lever returns to said latched position allowing said latch member to extend downward such that said inner surface of said keeper stop is disposed to engage said inner surface of said back plate adjacent said opening to latch the gate in said latched position when a person attempts to open the gate.

5. The keyless gate latch of claim 1 wherein each dove tail joint comprises a tapered projection extending outwardly from an outer surface of said leg and a corresponding notch or recess formed on a back wall of said keeper housing on opposite sides of said slot.

6. The keyless gate latch of claim 5 wherein the position of said keeper housing relative to said keeper housing support is adjusted by extending an adjustment screw through an aperture and into a threaded hole then turning the adjustment screw until said latch member is aligned with the actuator lever.

7. The keyless gate latch of claim 1 further including a keeper housing support wherein the position of said keeper housing relative to said keeper housing support is adjusted by extending an adjustment screw through an aperture and into said threaded hole then turning the adjustment screw until said latch member is aligned with said actuator lever.

8. A keyless gate latch to selectively latch a gate to a fence post wherein said keyless gate latch comprises a keeper assembly including keeper housing attached to the outer surface of the fence post by a keeper mount and extending outwardly therefrom, said keeper assembly further including a latch member having a keeper stop and movable between a latched position and an unlatched position normally biased in said latched position and a latch assembly attached to the outer surface of the gate and including an actuator lever rotatably between a latched position and an unlatched position at least partially disposed within a latch housing and a lever housing extending outwardly from said latch housing and including a latch stop such that when said latch member and said actuator lever are each in said latched position, said keeper stop and said latch stop engage each other to prevent the gate from being opened when a person attempts to open the gate and when said actuator lever is rotated from said latched position to said unlatched position said actuator lever engages said latch member moving said latch member from said latched position to said unlatched position preventing said keeper stop from engaging said latch stop allowing the gate to be opened and wherein said latch member comprises an inner surface including said keeper stop and said lever housing comprises a front plate and a back plate including an opening formed through said back plate and having an inner surface and an outer surface to cooperatively form a lever cavity to house a distal portion of said actuator lever; wherein, when said gate is moved toward a closed position, said lever cavity is configured to house said keeper assembly therein when said actuator lever is in said latched position.

9. The keyless gate latch of claim 8 wherein keeper assembly is attached to the fence post by said a keeper mount comprising a bracket including a pair of substantially vertical, substantially parallel dove tailed joints extending outwardly from a surface of said bracket and a keeper housing support disposed between said substantially parallel, substantially vertical dove tail joints including a slot wherein each dove tail joint comprises a tapered projection extending outwardly from an outer surface of said leg and a corresponding notch or recess formed on a back wall of said keeper housing on opposite sides of the slot.

10. The keyless gate latch to selectively latch a gate to a fence post of claim 8 wherein said keeper mount comprises a bracket including a pair of substantially vertical, substantially parallel dove tailed joints extending outwardly from a surface of said bracket and a keeper housing support disposed between said substantially parallel, substantially vertical dove tail joints including a slot.

11. The keyless gate latch to selectively latch a gate to a fence post of claim 2 wherein each said dove tail joint comprises a tapered projection extending outwardly from an outer surface of said leg and a corresponding notch or recess formed on a back wall of said keeper housing on opposite sides of the slot.

* * * * *